United States Patent [19]

Hodgson et al.

[11] 3,976,201

[45] Aug. 24, 1976

[54] SUPPORTING AND DISPLAYING APPARATUS FOR MERCHANDISE ITEMS

[75] Inventors: Robert J. Hodgson, Lomita; Henry Clark, Gardena, both of Calif.

[73] Assignee: Pacific Electricord Company, Gardena, Calif.

[22] Filed: Mar. 12, 1975

[21] Appl. No.: 557,483

[52] U.S. Cl. ..... 211/59; 248/DIG. 3

[51] Int. Cl.[2] ..... A47F 5/00

[58] Field of Search ..... 211/57, 59, 106; 248/DIG. 3, 223, 290; 40/16, 16.2, 16.4, 16.6, 19.5

[56] References Cited

UNITED STATES PATENTS

| | | | |
|---|---|---|---|
| 2,754,974 | 7/1956 | Larson | 211/59 UX |
| 2,974,804 | 3/1961 | Maro | 248/DIG. 3 |
| 3,139,985 | 7/1964 | Sinclair | 211/59 |
| 3,245,547 | 4/1966 | Felkay | 211/59 |
| 3,285,425 | 11/1966 | Nervig et al. | 211/59 |
| 3,374,898 | 3/1968 | Karmin | 211/59 |
| 3,452,954 | 7/1969 | Lucietto et al. | 248/DIG. 3 |
| 3,645,485 | 2/1972 | Gold | 211/59 X |
| 3,715,096 | 2/1973 | Filbert | 248/DIG. 3 |

*Primary Examiner*—Roy D. Frazier
*Assistant Examiner*—Robert W. Gibson, Jr.
*Attorney, Agent, or Firm*—Fulwider, Patton, Rieber, Lee & Utecht

[57] ABSTRACT

Apparatus for supporting and displaying merchandise items on a gondola or the like that includes an elongated horizontal bracket formed with a plurality of longitudinally spaced, vertically aligned apertures. These apertures removably receive the rear ends of a number of forwardly projecting hangers upon which the merchandise items are hung. A price strip holder is supported by the brackets immediately above the hangers.

2 Claims, 7 Drawing Figures

FIG. 3
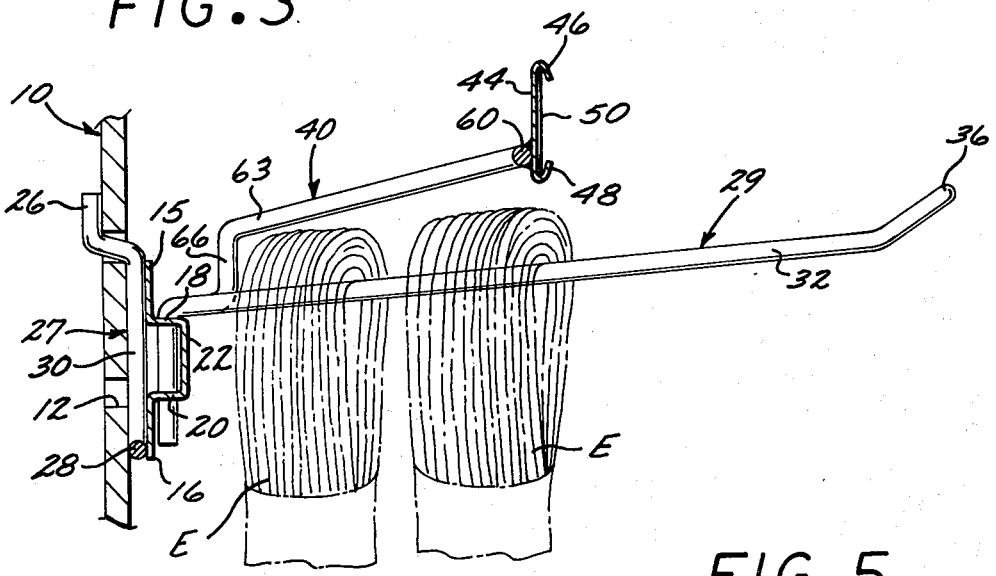
FIG. 4
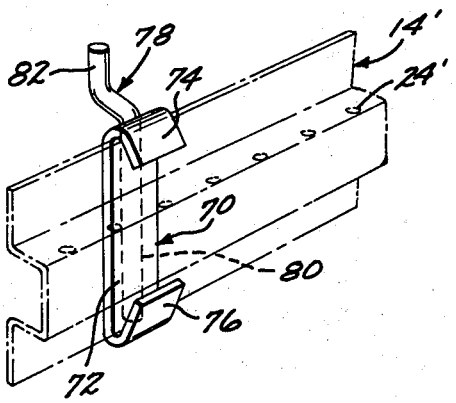
FIG. 5
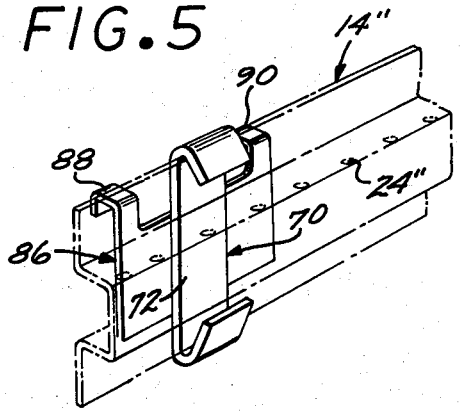
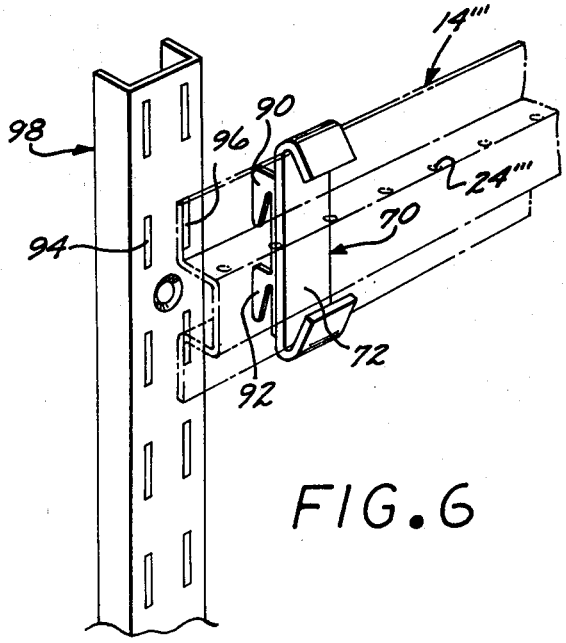
FIG. 6
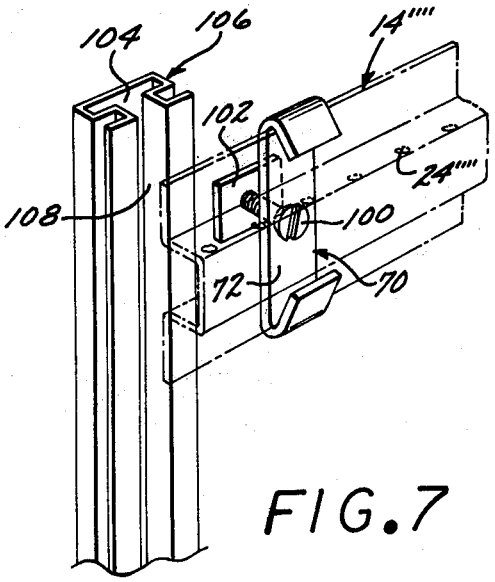
FIG. 7

SUPPORTING AND DISPLAYING APPARATUS FOR MERCHANDISE ITEMS

BACKGROUND OF THE INVENTION

This invention relates generally to the art of merchandising and, more particularly, to improved apparatus for concurrently supporting and displaying merchandise items and the prices thereof.

Display fixtures such as gondolas and wall fixtures are utilized for selling various items of merchandise as for example, electrical extension cords. Prior arrangements have employed a plurality of forwardly projecting hooks upon which the coiled extension cords are supported. A price strip has been positioned adjacent the rear of the hooks. Devices of this nature have been comparatively inflexible with respect to adjusting the spacing between the hooks. Additionally, because the price strips have been positioned adjacent the plane of the rear end of the hooks, the price strips below the first row of hooks have been difficult to read, the merchandise supported upon such first row of hooks hindering visibility of the lower price strips. Another serious disadvantage of the prior display arrangements resulted from the sharp configuration of the front ends of the hooks. It has not been uncommon for purchasers to have their eyes injured by inadvertent contact with the front ends of such hooks while bending over to remove the merchandise from the lower rows of hooks.

SUMMARY OF THE INVENTION

It is a major object of the present invention to provide apparatus for supporting and displaying merchandise and the price of such merchandise which permits the price strip to be readily visible to purchasers at all times.

It is another object of the present invention to provide apparatus of the aforedescribed nature utilizing a plurality of hangers, the longitudinal spacing of which may be readily varied.

Yet a further object of the present invention is to provide apparatus of the aforedescribed nature utilizing unique hangers which have rounded front ends to thereby minimize the effect of human contact therewith.

It is yet another object of the present invention to provide apparatus of the aforedescribed nature which is simple in design, and economical of construction which will afford a long and useful service life.

Other objects and advantages of the present invention will become apparent from the following detailed description, when taken in conjunction with the accompanying drawings.

BRIEF DESCRIPTION OF THE DRAWINGS

FIG. 3 is a vertical sectional view taken in enlarged scale along line 3—3 of FIG. 1;

FIG. 4 is a perspective view showing a second form of said apparatus;

FIG. 5 is a perspective view showing a third form of said apparatus;

FIG. 6 is a perspective view showing a fourth form of said apparatus; and

FIG. 7 is a perspective view showing a fifth form of said apparatus.

DESCRIPTION OF A PREFERRED EMBODIMENT

Figure 1:
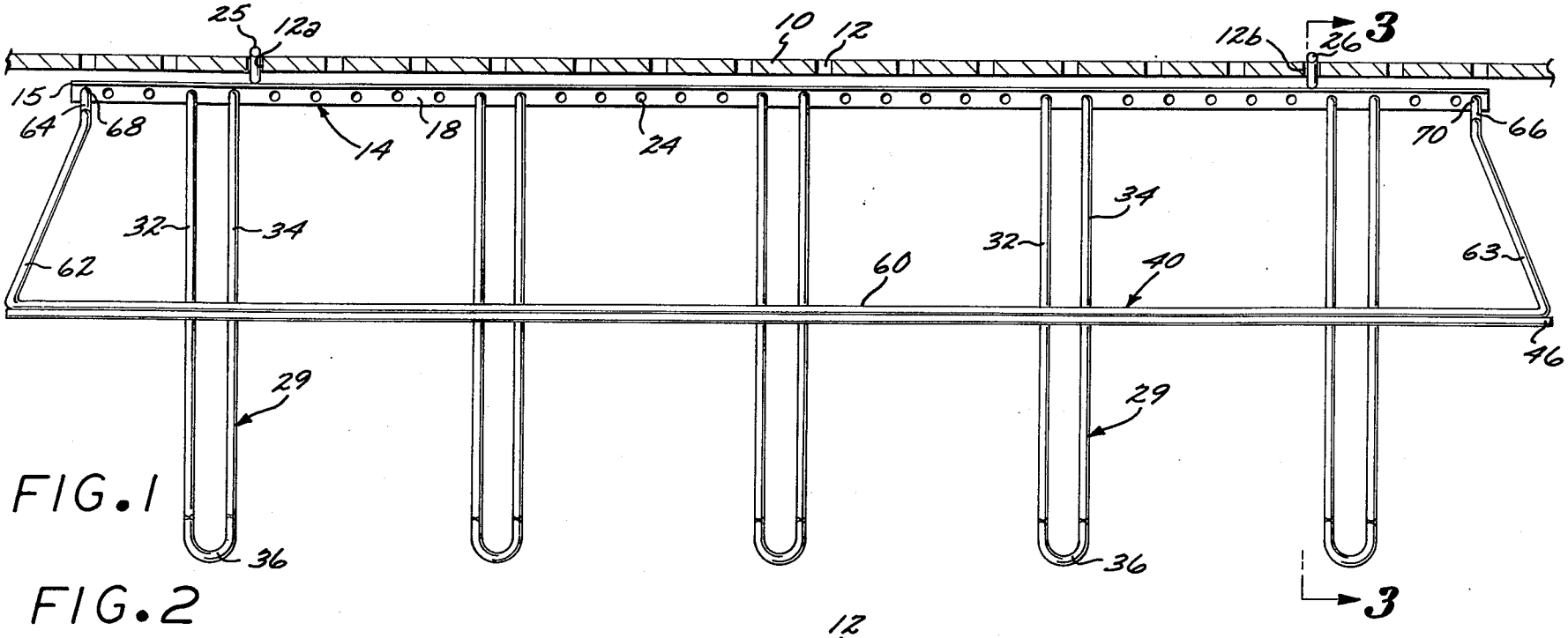
FIG. 1 is a top plan view showing a preferred form of supporting and displaying apparatus embodying the present invention.
Figure 2:
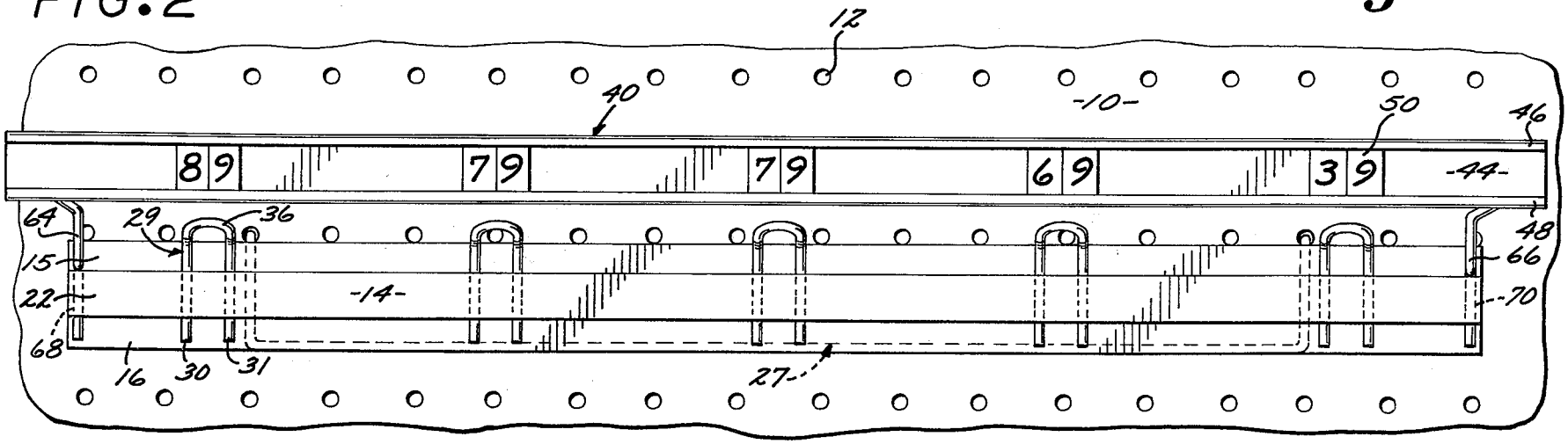
FIG. 2 is a front elevational view of said apparatus.

Referring to the drawings and particularly FIGS. 1, 2 and 3 thereof, there is shown a preferred form of supporting and displaying apparatus embodying the present invention. The apparatus is adapted for use with a perforated wall board 10 commonly termed a "peg board", which is vertically arranged within a gondola, wall fixture or the like (not shown) located at a retail outlet so as to display merchandise items, as for example, coiled electrical extension cords E shown in phantom outline in FIG. 4 of the drawings. Peg board 10 includes a number of horizontal rows of longitudinally spaced holes 12 of equal diameter.

More particularly, the supporting and displaying apparatus of FIGS. 1, 2 and 3 includes an elongated horizontal bracket, generally designated 14, having upper and lower vertical walls 15 and 16 that are integrally connected by top and bottom horizontal legs 18 and 20 that project forwardly from the upper and lower walls 15 and 16, respectively, and a vertical web 22 that bridges the front of these legs. A plurality of vertically aligned pairs of apertures 24 are formed through the legs 15 and 16. The bracket 14 is adapted to be removably supported upon the peg board 10 by the upper portion of a pair of upstanding prongs 25 and 26 defined by the ends of a generally U-shaped wire generally designated 27, which is rigidly affixed to the upper and lower walls 15 and 16 of bracket 14, as by welding or brazing. The prongs 25 and 26 are inclined rearwardly above wall 15 and then upwardly with respect to the opposite ends of the bight 28 of wire 27, as shown particularly in FIG. 3. As indicated by this figure the upper portion of prongs 25 and 26 are inserted within holes 12*a* and 12*b* of peg board 10.

Bracket 14 is adapted to support a plurality of like generally hairpin-shaped display hangers, generally designated 29. Each hanger 29 is of integral construction and includes a pair of upwardly extending fingers 30 and 31, the upper ends of which merge with the rear ends of a pair of forwardly extending arms 32 and 34. The front ends of arms 32 and 34 are connected by a forwardly and upwardly inclined loop 36.

As indicated particularly in FIG. 3, the arms 32 and 34 are inclined upwardly so as to retain the coiled extension cords E upon hangers 26. With continued reference to this figure, it will be noted that the fingers 30 and 31 are inserted within a pair of adjoining apertures 24 of the bracket 14 so as to support the hangers 29 firmly thereupon. It will be apparent that the number and longitudinal spacing of hangers 29 with respect to bracket 14 may be readily varied by merely removing such hangers from the bracket and repositioning them thereon at different relative spacings. No tools are needed. Yet the fingers 30 and 31 will solidly retain the hangers secured to the bracket even when the hangers are loaded with merchandise items.

The apertures of the present invention also includes a price strip support, generally designated 40. This member includes a price strip-receiving channel having a vertical face 44, a forwardly and downwardly bent lip 46 and a forwardly and upwardly bent lip 48 at its upper and lower edges, respectively. As shown in FIG. 2, price strips 50 are slidably retained within lips 46 and 48. These price strips are vertically aligned with hangers 29 so as to display the price of the merchandise item supported by each such hanger. The lower rear portion of face 44 is rigidly affixed as by welding to the front end of a bent wire frame that includes a bight portion 60 from the opposite ends of which there extends a pair of rearwardly and downwardly inclined legs 62 and 63, with the rear ends thereof being provided with depending fingers 64 and 66. The lower portion of fingers 64 and 66 are inclined downwardly and rearwardly and then vertically, as shown particularly in FIG. 3. The vertical components of these fingers are removably insertable within vertically aligned holes 68 and 70 formed at the extremeties of the bracket 14. It is important to note that the price strips 50 are disposed immediately above the intermediate portion of the hangers 29 and will therefore be clearly visible to a shopper. This visibility is afforded even with respect to the hangers 29 and their contents arranged below the top rows of the plurality of rows of hangers.

Referring now to FIG. 4, there is shown a second form of supporting and display apparatus embodying the present invention. In this form of the invention the bracket 14, hangers 26 and price strip support 40 may be assumed as being identical to the units described hereinbefore in conjunction with FIGS. 1, 2 and 3, with the exception of the means employed to support the bracket 14 upon a peg board, and like parts bear primed reference numerals. Thus, in the apparatus of FIG. 4 the bracket 14' is not affixed directly to the peg board. Instead bracket 14' is slidably supported within a mounting strap, generally designated 70 having a vertical leg 72 integral with a pair of forwardly bent upper and lower lips 74 and 76. The rear surface of the vertical leg 72 is rigidly affixed as by welding to a mounting prong, generally designated 78 having an upright leg 80, the upper end of which merges into rearwardly and upwardly inclined mounting finger 82. It should be understood that the support finger 82 of prong 78 is removably insertable within any of the holes 12 formed in the aforedescribed peg board 10. It will be further understood that bracket 14' is supported by a pair of the aforementioned mounting straps 70 with respect to the peg board 10. Utilization of the mounting straps 70 permit the bracket 14' and its components to be readily removed for cleaning, restocking with merchandise items or for varying the longitudinal spacing between the hangers 26 described hereinbefore. Note that in the interest of clarity hangers 26 and price strip support 40 are not shown in FIG. 4.

Referring now to FIG. 5, there is shown a third form of supporting and display apparatus embodying the present invention. As in the case of the embodiment of FIG. 4, the bracket 14'', hangers 26 and the price strip support 40 may be assumed as being identical to the units described hereinbefore in conjunction with FIGS. 1, 2 and 3. Hangers 26 and price strip support 40 are not shown in FIG. 5. It will be noted that the embodiment of FIG. 5 employs a generally C-shaped mounting strap 70 identical to that shown in FIG. 4 to receive bracket 14''. In the embodiment of FIG. 5, however, the vertical leg 72 of the mounting strap 70 is rigidly affixed as by welding to the midportion of a mounting plate, generally designated 86, of bifurcated construction employing a pair of hooks 88 and 90 which are insertable within the holes of a conventional peg board (not shown).

Referring now to FIG. 6, there is shown a fourth form of supporting and display apparatus embodying the present invention. In the embodiment of FIG. 6 there is again utilized a mounting strap 70 identical to that employed in the forms of the invention of FIGS. 4 and 5, together with hangers 26 and a price strip support that are not shown in the interest of clarity. The vertical leg 72 of the mounting strap 70 of this form of the invention, however, is provided with upper and lower pairs of prongs 90 and 92 selectively insertable within complementary pairs of vertical slots 94 and 96 formed in vertical spaced relationship in an upright standard generally designated 98. It will be understood that a pair of such mounting straps will be employed with a pair of such upright standards, and that the mounting straps slidably receive bracket 14'''.

Finally, referring to FIG. 7, there is shown a fifth form of supporting and display apparatus embodying the present invention. Again a generally C-shaped mounting strap 70 is employed to slidably receive a bracket 14'''', however, the vertical leg 72 thereof receives a threaded screw 100 which is screwed into a complementary pad 102. The pad 102 in turn is insertable within the vertical channel generally designated 104 of a conventional upstanding track generally designated 106, the shank of the screw 100 extending through a groove 108. The screw 100 is arranged so as to adjustably position the mounting strap 70 at a desired height within the channel 104. Again it will be understood that a pair of such mounting straps 70 and a pair of such upright channels 104 are employed.

Various modifications and changes may be made with respect to the foregoing detailed description without departing from the spirit of the present invention.

We claim:

1. Supporting and display apparatus for temporarily retaining a plurality of merchandise items on a perforated vertical wall of a gondola or the like, said apparatus comprising:

an elongated horizontal bracket having upper and lower vertical walls that are integrally connected by top and bottom horizontal legs that project forwardly from said upper and lower walls and a vertical web that bridges the front of said legs;

a plurality of vertically aligned pairs of longitudinally spaced apertures formed through said legs;

fastening means on said bracket for removably attaching said bracket to a gondola or the like, said fastening means including a pair of longitudinally spaced mounting straps which longitudinally slidably receive said mounting bracket, with a pair of upstanding prongs being attached to said mounting straps and extending rearwardly and upwardly through the perforations of said vertical wall; and a plurality of merchandise-supporting generally hairpin-shaped wire display hangers, each having a pair of upwardly extending fingers the upper ends of which integrally merge with the rear ends of a pair of forwardly extending arms, with the front ends of said arms being connected by a forwardly and upwardly inclined loop, and with each of said fingers being removably inserted within one of the pairs of apertures of said bracket whereby the longitudinal spacing of said hooks relative to said bracket may be varied.

2. Supporting and display apparatus for temporarily retaining a plurality of merchandise items on a vertical wall of a gondola or the like, said apparatus comprising:

an elongated horizontal bracket having upper and lower vertical walls that are integrally connected by top and bottom horizontal legs that project forwardly from said upper and lower walls and a vertical web that bridges the front of said legs;

a plurality of vertically aligned pairs of longitudinally spaced apertures formed through said legs;

fastening means on said bracket for removably attaching said bracket to a gondola or the like and including a pair of longitudinally spaced mounting straps which longitudinally slidably receive said elongated horizontal bracket and a pair of upstanding prongs attached to said mounting straps and which extend rearwardly and upwardly through perforations of said vertical wall;

a plurality of merchandise-supporting generally hairpin-shaped wire display hangers, each having a pair of upwardly extending fingers the upper ends of which integrally merge with the rear ends of a pair of forwardly extending arms, with the front ends of said arms being connected by a forwardly and upwardly inclined loop, and with each of said fingers being removably inserted within one of the pairs of apertures of said bracket whereby the longitudinal spacing of said hooks relative to said bracket may be varied;

a horizontal price strip support formed with a price strip-receiving channel rigidly connected to a bent wire frame that includes a bight portion from the opposite ends of which extend a pair of rearwardly and downwardly extending legs, with the rear end of said legs being provided with depending fingers that are removably positioned within a pair of vertically aligned holes formed in the legs of said horizontal bracket outwardly of the outermost of said display hangers; and a plurality of price strips, each removably carried within said price strip-receiving channel immediately above the intermediate portion of one of said display hangers.

* * * * *